US007977629B2

(12) United States Patent
McEwen et al.

(10) Patent No.: US 7,977,629 B2
(45) Date of Patent: Jul. 12, 2011

(54) ATMOSPHERIC PRESSURE ION SOURCE PROBE FOR A MASS SPECTROMETER

(75) Inventors: Charles Nehemiah McEwen, Newark, DE (US); Richard Garrett McKay, Hockessin, DE (US)

(73) Assignee: M&M Mass Spec Consulting, LLC, Hockessin, DE (US)

( * ) Notice: Subject to any disclaimer, the term of this patent is extended or adjusted under 35 U.S.C. 154(b) by 399 days.

(21) Appl. No.: 12/231,524

(22) Filed: Sep. 3, 2008

(65) Prior Publication Data

US 2011/0031392 A1 Feb. 10, 2011

Related U.S. Application Data

(60) Provisional application No. 60/975,385, filed on Sep. 26, 2007.

(51) Int. Cl.
*H01J 49/10* (2006.01)
*H01J 49/26* (2006.01)

(52) U.S. Cl. ..... 250/288; 250/281; 250/282

(58) Field of Classification Search ..... 250/281, 250/282, 283, 288
See application file for complete search history.

(56) References Cited

U.S. PATENT DOCUMENTS

| | | | | |
|---|---|---|---|---|
| 4,861,989 | A * | 8/1989 | Vestal et al. | 250/288 |
| 4,968,885 | A * | 11/1990 | Willoughby | 250/288 |
| 7,544,933 | B2 * | 6/2009 | Cooks et al. | 250/288 |
| 2004/0094706 | A1 * | 5/2004 | Covey et al. | 250/288 |
| 2006/0125477 | A1 * | 6/2006 | Killoran et al. | 324/321 |
| 2006/0145089 | A1 * | 7/2006 | Cristoni et al. | 250/423 F |
| 2008/0272286 | A1 * | 11/2008 | Vestal | 250/282 |
| 2010/0096542 | A1 * | 4/2010 | Whitehouse et al. | 250/282 |

* cited by examiner

*Primary Examiner* — Robert Kim
*Assistant Examiner* — Nicole Ippolito Rausch
(74) *Attorney, Agent, or Firm* — Michael F. Petock, Esq.; Douglas J. Petock; Petock & Petock, LLC

(57) ABSTRACT

An ion source able to ionize both liquid and gaseous vapors from interfaced liquid separation techniques and a solids/liquid atmospheric pressure (AP) probe. The liquid effluents are ionized by electrospray ionization, photoionization or atmospheric pressure chemical ionization and the vapors released from a probe device placed in a heated gas stream in the AP source are ionized by a corona or Townsend electrical discharge or photoionization. The source has the ability to ionize compounds from both liquid and solid sources, which facilitates ionization of volatile and semivolatile compounds by applying heat from a gas stream as well as highly non-volatile compounds infused by electrospray or separated by liquid chromatography or capillary electrophoresis.

26 Claims, 5 Drawing Sheets

ATMOSPHERIC PRESSURE ION SOURCE PROBE FOR A MASS SPECTROMETER

CITED PATENTS

U.S. Pat. No. 7,112,785
WO2006060130
US20060255261
US20010013579
U.S. Pat. No. 7,078,681
U.S. Pat. No. 7,002,146
U.S. Pat. No. 6,297,499
U.S. Pat. No. 5,788,166
U.S. Pat. No. 5,245,192
U.S. Pat. No. 6,646,256
U.S. Pat. No. 6,630,664
US20030111598
US2002148974
JP2002228636
WO2002060565
U.S. Pat. No. 6,474,136
US2003092193
US2003086826
U.S. Pat. No. 6,032,513
U.S. Pat. No. 6,418,781
JP09015207
JP06034616

NON-PATENT CITATIONS

Horning, E. C., et al., *New Picogram Detection System Based on a Mass Spectrometer with an External Ionization Source at Atmospheric Pressure*, Anal. Chem., 1973, 45, 936-943.

Dzidic, et al., *Comparison of Positive Ions Formed in Nickel-63 and Corona Discharge Ion Sources using Nitrogen, Argon, Isobutene, Ammonia, and Nitric Oxide as Reagnts in Atmospheric Pressure Ionization Mass Spectrometry*, Anal. Chem.m 1976, 48, 1762-1768.

McEwen, C. N., et al., *Analysis of Solids, Liquids and Biological Tissue Using Solids Probe Introduction at Atmospheric Pressure on Commercial LC/MS Instruments*, Anal. Chem., 2005, 77, 7826-7831.

McEwen, C. N., et al., *Analysis of the Inhibition of the Ergosterol Pathway in Fungi Using the Atmospheric Solids Analysis Probe Method*, J. Am. Soc. Mass Spectrom., 2007, 18, 1274-1278.

Dzidic, et al., *Atmospheric Pressure Ionization Mass Spectrometry: Formation of Phenoxide Ions from Chlorinated Aromatic Compounds*, Anal. Chem., 1975, 47, 1308-1312.

Totte-Rodriquez, et al., *Desorption Electrospray Ionization of Explosives on Surfaces: Sensitivity and Selectivity Enhancements by Reactive Desorption Electrospray Ionization*, Anal. Chem., 2005, 77, 6755-6764.

Horning, E. C., et al., *Development and Use of Analytical Systems Based on Mass Spectrometry*, Clin. Chem., 1977, 23, 13-21.

Carrot, D. I., et al., *Atmospheric Pressure Ionization Mass Spectrometry; Corona Discharge Ion Source for use in a Liquid Chromatography-Mass Spectrometry-Computer Analyticla System*, Anal. Chem., 1975, 47, 2369-2373.

Ketkar, S. N., et al., *Real-time Detection of Parts per Trillion of Chemical Warfare Agents in Ambient Air Using Atmospheric Pressure Ionization Quadrupole Mass Spectrometry*, Anal. Chem., 1991, 63, 457-459.

Lave, D. A., et al., *New Mass Spectrometer*, Adv. Mass Spectrom., 1980, 8B, 1843.

Riter, C. L., *Direct Analysis of Semivolatile Organic Compounds in Air by Atmospheric Pressure Chemical Ionization Mass Spectrometry*, J. Agric. Food Chem., 2000, 48, 5389-5395.

Snyder, A. P., *Curie-point Pyrolysis Atmospheric Pressure Chemical Ionization Mass Spectrometry: Preliminary Performance Data for Three Polymers*, Anal. Chem., 1987, 59, 1945-1951.

Steiner, et al., *Secondary Ionization of Chemical Warfare Agent Stimulants; Atmospheric Pressure Ion Mobility Time-of-Flight Mass Spectrometry*, Anal. Chem., 2003, 75, 6068-6076.

FIELD OF INVENTION

This invention relates to an atmospheric pressure ionization (API) source comprising ionization of liquid effluents either by electrospray (ESI) or atmospheric pressure chemical ionization (APCI) and also facilitates rapid analysis of solid or liquid samples and materials by direct introduction into the API source to permit ionization and subsequent mass separation of the ions by a mass spectrometer. This invention also relates to a device, using a commercial mass spectrometer ionization source, of introducing the analyte on the surface of a heat tolerant material into a heated nitrogen stream which may emanate from either a commercial ESI or APCI probe so that the analyte is vaporized with subsequent ionization using either a discharge or photoionization. This invention also relates to a method, using the ionization source, of increasing the compounds that can be ionized in an API source by eliminating solvent which hinders or prevents ionization of nonpolar analytes. This invention also relates to use of adsorption materials to concentrate vaporizable compounds from gas or solution for subsequent vaporization using a heated gas and ionization of the vaporized compounds in an API source. This invention also relates to imaging a surface for chemical components using a fine stream of heated gas to vaporize volatile compounds with subsequent ionization at atmospheric pressure and mass analysis with a mass spectrometer.

As used in this invention a probe is a means of introducing sample into the ionization region of a mass spectrometer and may include a flange device for aligning the probe. The ESI and APCI probe assemblies are commercially available and present on most API sources. The direct introduction solids/liquid probe assembly used to introduce solid, liquid or material samples directly into the API source is similar in many respects to so called solids probe devices used to introduce samples into electron or chemical ionization sources that operate under vacuum conditions. The API solids/liquid introduction probe, however, does not require a vacuum lock and is thus a much faster sample introduction method. It also preferably uses the heated nitrogen stream from the commercially available ESI or APCI probes for sample vaporization rather than resistive heating of the surface containing the sample. The probe is designed to align the sample on a heat resistance device such as a melting point tube in the heated gas from an ESI or APCI probe or a specially built device for producing a stream of heated gas. Employing the ionization source of the present invention, a single atmospheric pressure ionization mass spectrometer of any type is made capable of ionizing solids, liquids, tissue and material samples in addition to analytes in solvents.

BACKGROUND

As used herein, the term solid/liquid probe refers to a shaft and flange assembly that allows introduction of a sample on the surface of a heat resistant material into a heated gas stream in the atmospheric pressure ion (API) source of a mass spectrometer. The term ESI probe refers to a commercially available device for ionization of analyte in a liquid stream using a high voltage that is interfaced to a mass spectrometer through the API source. The term APCI probe refers to a commercially available device for ionization of analyte in a liquid by nebulizing the liquid into droplets and vaporizing the liquid droplets with subsequent ionization using a corona discharge with mass analysis by a mass spectrometer. The current practice in mass spectrometry is to have either APCI or ESI ionization methods, both of which ionize analyte from a liquid stream. No commercial API instrument includes a direct solids/liquid introduction probe.

Atmospheric pressure ionization mass spectrometers (APIMS) instruments currently available lack flexibility. They primarily accept only liquid effluent from which analyte ions are produced by electrospray ionization, atmospheric pressure chemical ionization, or photoionization. A recent configuration has been published in which a gas chromatograph was also interfaced to the API source so that either a liquid or a gas stream from a gas chromatograph could be ionized (WO 2006/060130 A2, McEwen). Typically, primary ions are formed at atmospheric pressure by initiation of a gaseous electrical discharge by an electric field or by electrospray ionization (ESI) as described in U.S. Pat. No. 6,297,499 (Fenn) and; U.S. Pat. No. 5,788,166 (Valaskovic). The primary ions in turn ionize the gas phase analyte molecules by either an ion-molecule process as occurs in atmospheric pressure chemical ionization (APCI), by a charge transfer process, or by entraining the analyte molecules in a charged droplet of solvent produced in the electrospray process. In the case of analyte being entrained in a charged liquid droplet, the ionization process is the same as in electrospray ionization (ESI) because the analyte molecules are first entrained in the liquid droplets and subsequently ionized.

Electrospray ionization (ESI) is a powerful method for producing gas phase ions from compounds in solution. In ESI, a liquid is typically forced from a small diameter tube at atmospheric pressure. A spray of fine droplets is generated when a potential of several thousand volts is applied between the liquid emerging from the tube and a nearby electrode. Charges on the liquid surface cause instability so that droplets break from jets extending from the emerging liquid surface. Evaporation of the droplets, typically using a counter-current gas, leads to a state where the surface charge again becomes sufficiently high (near the Raleigh limit) to cause instability and further smaller droplets are formed. This process proceeds until free ions are generated by either the evaporation process described above or by field emission that occurs when the field strength in the small droplets is sufficiently high for field evaporation of ions to occur. Molecules more basic than the solvent being used in the ESI process are preferentially ionized. Because ESI generates gas phase ions from a liquid, it is an ideal ionization method for interfacing liquid chromatography (LC) to mass spectrometry (MS). The power of ESI for the analysis of compounds as large and diverse as proteins won the 2003 Nobel prize in Chemistry for John Fenn. The combination of ESI with MS with liquid separation methods is extremely powerful analytically and results in large numbers of LC/MS instruments being sold each year.

Because ESI is most sensitive and most suitable for basic and polar compounds, most LC/MS instrumentation incorporates an alternative atmospheric pressure ionization technique called atmospheric pressure chemical ionization (APCI). APCI was initially developed by Horning, et al. using $^{63}$Ni beta decay for ionization. See Horning, E. C.; Horning, M. G.; Carroll, D. I.; Dzidic, I.; Stillwell, R. N., *New Picogram Detection System Based on a Mass Spectrometer with an External Ionization Source at Atmospheric Pressure*. Anal. Chem., 1973. 45: p. 936-943. A discharge ion source has since replaced the $^{63}$Ni as the source of ionization. A discharge is generated when a voltage, typically applied to a metal needle, is increased to a range where electrical breakdown (formation of free electrons and ions) of the surrounding gas occurs (typically several thousand volts). The primary use of this ionization method has been as an ionization interface between liquid chromatography and mass spectrometry. See Dzidic, I.; Carroll, D. I.; Stillwell, R. N.; Horning, E. C., *Comparison of Positive Ions formed in Nickel-63 and Corona Discharge Ion Sources using Nitrogen, Argon, Isobutene, Ammonia and Nitric Oxide as Reagents in Atmospheric Pressure Ionization Mass Spectrometry*. Anal. Chem., 1976. 48: p. 1763-1768. This ionization method relies on evaporation of the liquid exiting the liquid chromatograph with subsequent gas phase ionization in a corona discharge. The primary ions produced in the corona discharge are from the most abundant species, typically nitrogen and oxygen from air or solvent molecules. Regardless of the initial population of ions produced in the corona discharge, diffusion controlled ion-molecule reactions will result in a large steady state population of protonated solvent ions. These ions in turn will ionize analyte molecules by proton transfer if the reaction is exothermic or by ion addition if the ion-molecule product is stable and infrequently by charge transfer reactions. While this technique tends to be more sensitive than ESI for low molecular weight and less polar compounds, it nevertheless is not sensitive for highly volatile compounds and those less basic than the LC solvent. Thus, neither APCI nor ESI are good ionization methods for a large class of volatile and less polar compounds. For this reason, other ionization methods, such as photoionization have been applied to LC/MS to more effectively reach a subset of this class of compounds (See, for example U.S. Pat. Nos. 7,002,146, 5,245,192, 6,646,256, 6,630,664, US20030111598). Photoionization at atmospheric pressure uses an ultraviolet (UV) source for ionization of gas phase molecules. Typically, a plasma-induced discharge lamp that produces radiation in the range of 100-355 nm is used to generate ionization. Such a source is sold by Synagen Corporation for use with LC/MS.

Thus, liquid chromatographs interfaced with the atmospheric pressure ionization methods of ESI and APCI are in common use and frequently the mass spectrometers associated with these ionization methods have advanced analytical capabilities such as MS″ (MS/MS, MS/MS/MS, etc.) and/or high mass resolution and accurate mass analysis. However, LC/MS instruments do not effectively address a large class of important volatile and less polar compounds. Herein is described atmospheric pressure ionization of vaporizable compounds introduced into the ionization region as a neat liquid, solid, or as tissue or materials on instruments designed for LC/MS applications without interference with the operation of these liquid introduction techniques.

Solid probe introduction is commonly interfaced to mass spectrometers which use vacuum ionization methods such as electron or chemical ionization. The solid probe is limited to molecules that can be made to vaporize in vacuum by application of heat. Because solid probes on current mass spectrometers interface with ion sources that operate in vacuum, it must be inserted into the mass spectrometry through a pressure drop device. Commonly, the pressure drop device is a ball valve device with polymeric "O"-rings that seal the probe so that a vacuum can be achieved through a roughing pump before the ball valve is opened. Because this is a time intensive process and involves inserting the sample into vacuum, volatile compounds can be pumped away. Further, the device is available only on instruments having chemical and/or electron ionization, methods that operate substantially below atmospheric pressure.

To our knowledge, the only references to use of a direct insertion probe for introduction of samples into an API source are articles by McEwen, et al. (See McEwen, C. N.; McKay, R. G.; Larsen, B. S., Analysis of solids, liquids, and biological tissues using solids probe introduction at atmospheric pressure on commercial LC/MS instruments, Anal. Chem., 2005, 77, 7826-7831. McEwen, C.: Gutteridge, S., Analysis of the Inhibition of the Ergosterol Pathway in Fungi using atmospheric solids analysis probe (ASAP) method, J. Am. Soc. Mass Spectrom., 2007, 18, 1274-1278.) In these articles the only description given of the solids/liquid introduction was use of a Teflon® plug in a glass sleeve with a hole drilled through for insertion of a melting point tube into a hot nitrogen stream within the API source housing. A major disadvantage of this method is that in order for the melting point tube to align with the hot nitrogen the hole through which the tube was inserted had to be a tight fit. Inserting the melting point tube through the opening with sample on the exterior of the melting point tube resulted in sample being deposited on the Teflon® plug with subsequent cross contamination of later runs. Another drawback of the arrangement was the melting point tube, being made of glass, was hand held and would sometimes break when inserted through the plug which could result in injury. Finally, the probe was describe only for a QT of 'fishbowl' ion source housing which required drilling a hole through a glass sleeve which was a difficult process even for glass blowing experts. This approach is not viable on commercial instruments nor is it practical from a manufacturing point of view. Further, no description has been given of such a probe which does not interfere with the normal ESI/APCI operation of the mass spectrometer. In addition, no mention was made of using a fine stream of heated gas to image chemical composition from a surface nor was mention made of using adsorption materials for sample concentration.

Dzidic, et al. described the use of platinum wire to introduce chloro-nitrobenzene by volatilization into a specially built API source that used $^{63}$Ni as the source of ionization. The only description was that the platinum wire was resistively heated in a stream of nitrogen gas. From ion source descriptions in other publications, it is likely that the sample was introduced into the nitrogen stream outside the ion source and carried into the ionization region through a heated tube similar to the GC/API-MS experiments these authors carried out. (See Dzidic, I.; Carroll, D. I.; Stillwell, R. N., Horning, E. C., Atmospheric Pressure Ionization (API) Mass Spectrometry: Formation of Phenoxide Ions from Chlorinated Aromatic Compounds, Anal. Chem., 1975, 47, 1308-1312.). An open source experiment was reported in which a sample on a surface was ionized using charged droplets either from an electrospray device or from APCI in which the droplets were charged using a corona discharge. (See Cotte-Rodriquez, I.; Takats, Z.; Talaty, N.; Chen, H.; Cooks, R. G., Desorption Electrospray Ionization of Explosives on Surfaces: Sensitivity and Selectivity Enhancement by Reactive Desorption Electrospray Ionization, Anal. Chem., 2005, 77, 6755-6764.) The mechanism for this device is believed to be charge droplets hitting a surface with subsequent pickup of sample into smaller droplets that spatter into the gas phase with subsequent ionization. Another open source ionization method for direct analysis in real time uses an electric discharge device to produce metastable nitrogen or helium species which form reactant ions that when directed at analyte produces analyte ions (U.S. Pat. No. 7,112,785 B2, Laramee and Cody). Neither technique describes the use of heated gas to vaporize materials and both devices use open air sources which have the potential to emit hazardous gases into the surrounding area. Several patents describe multi-probe sources, non of which use a direct introduction solid/liquid introduction probe (US20010013579 A1, Andrien, Whitehouse, Shen, Sansone, U.S. Pat. No. 7,078,681 B2, Fischer, Gourlen, Bertsch, US20060255261 A1, Whitehouse, White, Willoughby, Sheehan).

Because work in the Horning group in the 1970's developed the APCI technique, we give here some important references. A review paper by E. C. Horning, et al discusses both GC/APIMS and LC/APIMS ion sources (See Horning, E. C.; Carroll, D. I.; Dzidic, I.; Haegele, K. D.; Lin, S.-N.; Oertil, C. U.; Stillwell, R. N., *Development and Use of Analytical Systems Based on Mass Spectrometry*. Clin. Chem., 1977. 23(1): p. 13-21). This article shows diagrams of each ion source and refers back to two previous publications for details on LC/APIMS and on GC/APIMS. (Respectively see Carroll, D. I.; Dzidic, I.; Stillwell, R. N.; Haegele, K. D.; Horning, E. C., *Atmospheric Pressure Ionization Mass Spectrometry: Corona discharge Ion Source for use in a Liquid Chromatography-Mass Spectrometry-Computer Analytical System*. Anal. Chem., 1975. 47: p. 2369-2373 and see Dzidic, I.; Carroll, D. I.; Stillwell, R. N.; Horning, E. C., *Comparison of Positive Ions formed in Nickel-63 and Corona Discharge Ion Sources using Nitrogen, Argon, Isobutene, Ammonia and Nitric Oxide as Reagents in Atmospheric Pressure Ionization Mass Spectrometry*. Anal. Chem., 1976. 48: p. 1763-1768.

Commercial mass spectrometers have been manufactured that analyze gaseous compounds using corona discharge APCI, e.g. ABB, Inc., Extrel Quadrupole mass spectrometers, described in Ketkar, S. N.; Penn, S. M.; Fite, W. I., *Real-time Detection of Parts per Trillion of Chemical Warfare Agents in Ambient Air Using Atmospheric Pressure Ionization Tandem Quadrupole Mass Spectrometry*. Anal. Chem., 1991. 63: p. 457-459. and Sciex. mass spectrometers, described in Lave, D. A.; Thompson, A. M.; Lovett, A. M.; Reid, N. M., Adv. Mass Spectrom., 1980. 8B: p. 1480. and Reid, N. M.; Buckley, J. A.; Pom, C. C.; French, J. B., Adv. Mass Spectrom., 1980. 8B: p. 1843. Two patents (EP 0819937 A2 and U.S. Pat. No. 5,869,344) which disclose use of a Venture pump in combination with water vapor introduction for analysis of trace volatiles in air from sources such as breath and fragrances emulating from skin and clothing. Papers by L. Charles, et al and by G. Zehentbauer, et al have been published that reportedly improve on this method. (Respectively see Charles, L.; Riter, L. S.; Cooks, R. G., *Direct Analysis of Semivolatiel Organic Compounds in Air by Atmospheric Pressure Chemical ionization Mass Spectrometry*. J. Agric. Food Chem., 2000. 48: p. 5389-5395. and see Zehentbauer, G.; Kirck, T.; Teineccius, G. A., J. Agric. Food Chem., 2000. 48: p. 5389-5395.) All of these methods introduce the sample into the API ionization region as a vapor and not directly as described in this application.

Pyrolysis with ionization of the gaseous pyrolysate has been reported, (see Snyder, A. P.; Kremer, J. H.; Mouzelaar, H. L. C.; Windig, W.; Taghizahed, K., *Curie-point pyrolysis atmospheric pressure chemical ionization mass spectrometry: preliminary performance data for three biopolymers*. Anal. Chem., 1987. 59: p. 1945-1951. while W. E. Steiner, et al has reported APCI of warfare agent simulants (see Steiner, W. E.; Glowers, B. H.; Haigh, P. E.; Hill, H. H., *Secondary Ionization of Chemical Warfare Agent Simulants: Atmospheric Pressure Ion Mobility Time-of-Flight Mass Spectrometry*. Anal. Chem., 2003. 75: p. 6068-6076.

A wafer thermal desorption system has been described for introducing samples into APIMS (in published US patent application US2002148974). Several patents (for example, JP2002228636, WO2002060565, U.S. Pat. No. 6,474,136, US2003092193, US2003086826, U.S. Pat. No. 6,032,513, U.S. Pat. No. 6,418,781, JP09015207, and JP06034616) discuss the use of GC and APIMS for the analysis and quantitation of trace gases such as hydrogen, oxygen, argon, carbon dioxide, carbon monoxide, freons, silanes, and other compounds that are gases at ambient temperature, primarily for the semiconductor industry. McLuckey, et al. (Atmospheric Sampling Glow Discharge Ionization Source for the Determination of Trace Organic Compounds in Ambient Air, Anal. Chem., 60, 1988, 2220-2227.) disclosed a method for observing volatile organic compounds in air using a glow discharge.

Currently available mass spectrometers do not combine LC/MS and solids/liquid probe in a single instrument or use API solids/liquid probes in any fashion. The great majority of mass spectrometers are either designed for LC/MS operation or vacuum ionization operation with a solids probe, but not both. Many laboratories will have both instruments with solids probe with a vacuum ionization source and LC/MS instruments with API ionization available, but a growing number of laboratories have only API LC/MS instrumentation. Therefore, it is desirable to devise an ionization source that allows commonly available LC/MS mass spectrometers to also be capable of direct sample introduction by means of a direct introduction liquid/solids probe. Such an instrument would extend the coverage of compounds that can be analyzed by currently available LC/MS instruments. Such an interface probe would have the additional advantage that the advanced capabilities common in LC/MS instruments, but not common in vacuum ionization instruments (e.g. techniques known to those practiced in the art such as cone-voltage fragmentation, MS″, high-mass resolution, accurate mass measurement) would become available to liquids/solids direct analysis without purchase of new and expensive instrumentation.

Further, the heated gas stream used to vaporize materials reduces thermal fragmentation relative to direct resistive heating of samples off of a metal wire or ribbon. Apparently, the gas stream applies heat to the sample/air interface so that molecules are immediately removed from the surface when they attain sufficient thermal energy to overcome surface forces. Application of a thin stream of hot gas allows selected areas of a surface to be heated with vaporization of volatile and semi-volatile compounds. Imaging of the surface for these compounds which may be metabolites, for example, becomes available. The compounds vaporizing from the surface are ionized by a corona discharge or by photoionization. Alternatively, a resistive heater or conductive heating can be used to vaporize compounds, the resistive heating method being especially applicable for pyrolysis.

SUMMARY OF INVENTION

An ionization source useful with an atmospheric pressure mass spectrometer, the source capable of ionizing liquid effluent from a preceding separation apparatus, such as a liquid chromatograph, and of introducing the ions from the atmospheric pressure region into the vacuum region of the mass spectrometer for mass analysis of the ions, the source comprising: an ionization arrangement for generating an electric discharge, the ionization arrangement being connected to a high voltage source, or a UV lamp for producing ions by photoionization; and an enclosure for enclosing the ionization arrangement thereby defining an ionization region, the enclosure having at least one port for introducing an effluent from a source of liquid effluent and an additional port for introducing sample into the ionization region directly as a solid, neat liquid, solution or material, and an aperture for introducing ions into the vacuum region of the mass spectrometer.

The enclosure further comprises a port for introducing a reactive gas and a vent for venting gas from the enclosure. The at least one port is for introduction of a liquid effluent for either ESI or APCI and an additional port, as described herein, for introduction of a solids/liquid probe.

The ionization arrangement for generating an electric discharge comprises a sharp-edged or pointed electrode onto which a high voltage is applied to generate a Townsend or corona discharge. The ionization arrangement for generating an electric discharge may comprise any arrangement in which a discharge is generated that supplies gas phase ions that ionize the analyte molecules at or near atmospheric pressure. The ionization arrangement may also comprise a suitable lamp for generating ionizing radiation such as a plasma induced discharge (PID) lamp.

The present invention also provides a method of increasing the scope of compounds that can be analyzed at atmospheric pressure by the elimination of solvent. Liquid introduction techniques provide copious amounts of solvent to the API region. The ions formed from water or solvent undergo exothermic, but not endothermic, proton transfer reactions. Thus, only compounds more basic than the source of the ionization (solvent or more appropriately ionized solvent clusters) are ionized. This reaction series can be shown for nitrogen gas containing the solvent water;

$$N_2+e \rightarrow N_2^{+}+2e$$

$$N_2^{+}+2N_2 \rightarrow N_4^{+}+N_2$$

$$N_4^{+}+H_2O \rightarrow H_2O^{+}+2N_2$$

$$H_3O^{+}+n(H_2O)+N_2 \rightarrow H^{+}(H_2O)_n+N_2$$

$$H^{+}(H_2O)_n+A \rightarrow AH^{+}+nH_2O \text{ (where A=analyte).}$$

Thus, there are many compounds that do not ionize efficiently with either ESI or liquid introduction APCI. Introducing samples on a probe as a solid, neat liquid or as a material eliminates the solvent and the ionization occurs by charge exchange from $N_2^{+}$ or $N_4^{+}$ or by protonation from the hydronium ($[H3O]^{+}$) ion produced from trace amounts of moisture. Thus, for example, charge transfer reactions between the inert gas and sample can occur which increases the scope of compounds that can be ionized. Compounds such as benzene, napthalene, chlorophenol, dodecene, and other compounds that are not ionized under liquid introduction API conditions can thus be ionized. In addition, compounds that are poorly ionized in liquid APCI or ESI are readily ionized by gas phase APCI using this methodology, thus increasing the sensitivity of analysis. Almost all vaporizable compounds can be ionized using this direct sample introduction method.

The present invention also provides a method for adding reactive gases to the ion source region to limit the kinds of compounds that can be ionized using the solids/liquid introduction probe. For example, addition of ammonia gas allows only compounds more basic than ammonia or those that form stable gas phase ion clusters with $NH_4^{+}$ to be ionized. This can be advantageous when the compounds of interest are highly basic compounds in a matrix of less basic compounds that are not of interest. An example would be ionization of amine containing compounds in, for example, fuel oil without ionization of aromatic hydrocarbons and oxygen containing compounds. An additional advantage is that the ionization event is a low energy proton transfer which eliminates or minimizes formation of fragment ions.

The present invention also provides a method for having the solids/liquid introduction probe assembly not interfere with the normal operations of LC/MS using either ESI or APCI. The configuration of the flange for the solids/liquid probe is such that when the probe is inserted into the flange it acts to close the ionization region from the external atmosphere without interference with the operation of ESI or APCI or of LC/MS. Therefore, switching between use of the solids/liquid probe, ESI, or APCI requires no more effort or time than switching between ESI and APCI.

The solids/liquid probe and flange are constructed of a heat resistant material that can be heated or cleaned to minimize or eliminate off-gases that add to the background ion current. The preferable material of construction is metal and more preferable stainless steel, aluminum, or brass. The position of the flange is such that a heat resistance tubular member that is held by the probe assembly can be inserted into the API source housing within the region of ionization. The tubular member which accepts the sample is made of a heat tolerant material, preferably glass or metal and most preferably a glass tube such as commercially available melting point tubes. The tubular member can also be made of or contain a material such as silica particles or fibers commonly used as liquid chromatography column adsorbents or as solid phase micro extraction (SPME) materials used with gas chromatography. This invention also relates to a plate that can be introduced into a heated nitrogen gas stream exiting a capillary, thus reducing the surface area impacted by the hot gas for imaging purposes.

In one configuration, the tip of the tubular member inserts into the heated gas from either the commercially available APCI probe or the ESI probe. The heated gas effects vaporization of the compounds composing the sample and the vaporized components are subsequently ionized in the gas phase by a discharge or by photoionization.

An alternative arrangement is to provide a source of heated gas, preferably nitrogen, which impinges on the tubular member at the location of the sample and thus vaporizes the compounds in the sample. This heated source can be in the location used by the ESI or APCI probes or it can be an alternative location, including concurrent with the tubular member. An alternative approach is to have a heater assembly built into the solids/liquid probe so that the sample is vaporized by the heat supplied to the probe by resistive or convective heating. In this configuration, metal, glass, and ceramic are preferably materials of construction. The heater can be as simple as a length of wire that resists oxidation during heating at atmospheric pressure. This configuration is especially useful for effecting pyrolysis of compounds such as polymers by rapid resistive heating. Heat can also be applied to a surface through a small capillary tube so as to vaporize compounds from a small area and allow surface imaging. The temperature for any of these methods can be controlled.

The present invention can use any commercially available mass spectrometer designed for LC/MS at atmospheric pressure. This invention allows analysis of samples using the solids/liquid probe to incorporate all of the potential of the mass spectrometer known to those skilled in the art for selected ion monitoring, for accurate mass measurement, for cone voltage fragmentation, for $MS^n$ experiments, and the like.

The present invention provides several advantages over the current art in mass spectrometry. By using an atmospheric pressure ion source and interface to the mass spectrometer, in accordance with the invention described herein, any LC/MS instrumentation can be converted to a dual LC/APIMS and direct solids/liquid probe configuration. Using the present invention, the effluent from an LC can be analyzed by mass spectrometry and compounds inserted into the source using the solids/liquid probe can likewise be analyzed. Further, the time to switch between the two operations is as short as a few seconds on many instruments.

The dual ion source described herein, when compared to LC/MS stand-alone instrumentation, is capable of ionizing a wider array of materials, of ionizing materials directly without sample extraction and other workup procedures. By using the method of the present invention, some chemical compound types that cannot be ionized by LC/APIMS can be ionized using the solids/liquid probe sample introduction method and many others are ionized with greater efficiency and sensitivity.

The solids/liquid API probe also has advantages over vacuum solids probe MS. Many LC/MS instruments are capable of accurate mass measurement and selected ion fragmentation (i.e., MS/MS) whereas few instruments with ionization under vacuum conditions have such capabilities. Conversion of LC/MS instrumentation having such features to the dual ion source of the present invention described herein also provides these features to solids/liquid probe operation.

The present invention is a device that enables direct solids/liquid introduction to commercially available atmospheric pressure ionization mass spectrometers (APIMS) which are designed to interface to liquid separation methods such a liquid chromatography (LC) or capillary electrophoresis (CE). The present invention provides a mass spectrometry apparatus that provides both direct sample introduction and LC/APIMS operation on the same instrument. The primary ionization process for the compounds vaporized from a solids/liquid introduction probe occurs at atmospheric pressure using a Townsend or Corona discharge or by photoionization.

Advantages of the API solids/liquid direct introduction probe include simple inter-conversion between LC/APIMS and direct sample introduction operation, extended range of compounds that can be analyzed by APIMS, and no vacuum limitation of the samples introduced into the ionization region. The ability to concentrate sample using such method as SPME with direct introduction into the ionization region and the ability to image materials such a tissue slices using a heated gas stream with subsequent API ionization are other advantages. Simplicity and speed of analysis are other advantages.

The present invention is also useful for the analysis of compounds that have sufficient volatility, or that can be made sufficiently volatile by using derivatization methods known in the art, to vaporize under a stream of hot nitrogen gas. As an example, solids/liquid probe introduction is useful for the analysis of environmental pollutants, compounds in biological tissue, forensic analyses, explosives, synthetic products, off-gas products from polymers and other solid or liquid materials, contaminants, drugs, metabolites, lipids, fatty acids, alcohols, aldehydes, amines, amino acids, esters, ethers, halogenated compounds, glycols, isocyanates, ketones, nitriles, nitroaromatics, pesticides, phenols, phosphorus compounds, polymer additives, prostaglandins, steroids, and sulfur compounds. Many of the compound types are difficult to detect with ESI or APCI, but can readily be detected in the sub-parts per million range using the present invention.

DETAILED DESCRIPTION OF THE INVENTION

Figure 1:
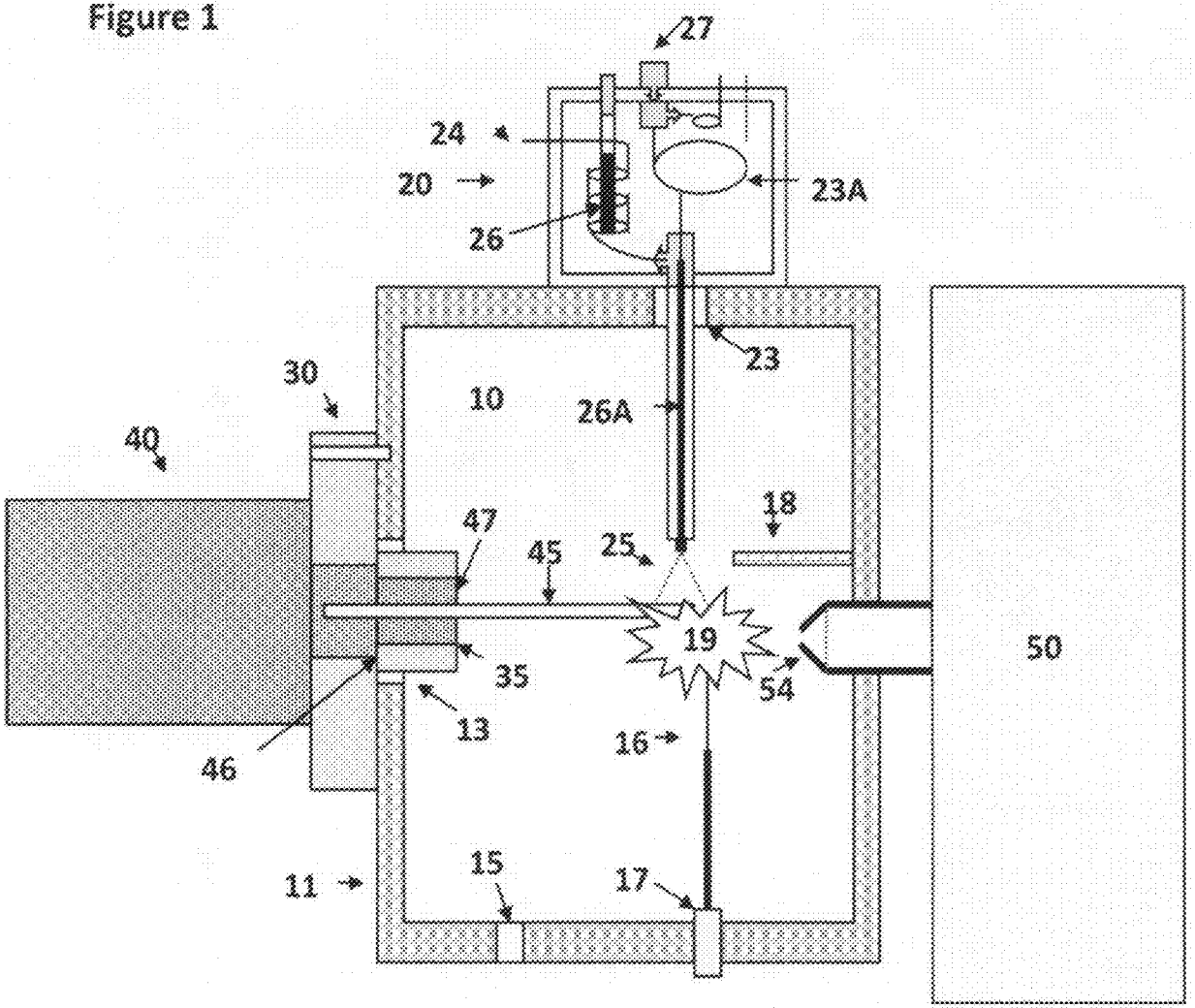
FIG. 1 is a sectional view of an embodiment of an API source region showing a flange for the solids/liquid probe, the solids/liquid probe, a discharge needle and the LC probe interfaced with the atmospheric pressure ionization region.
Figure 2:
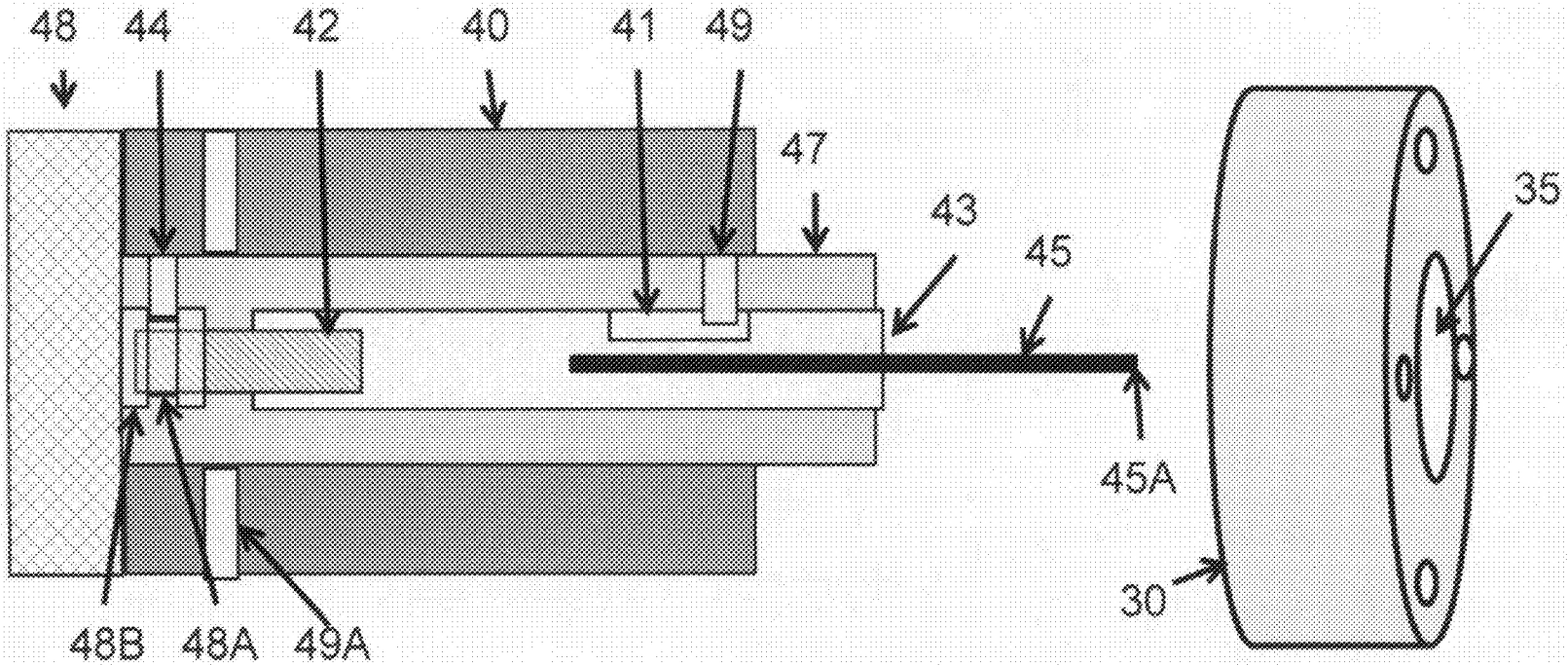
FIG. 2 is a sectional view of an embodiment of a solids/liquid probe for atmospheric pressure ionization and the associated flange for interfacing the probe with an atmospheric pressure ion source.
Figure 3:
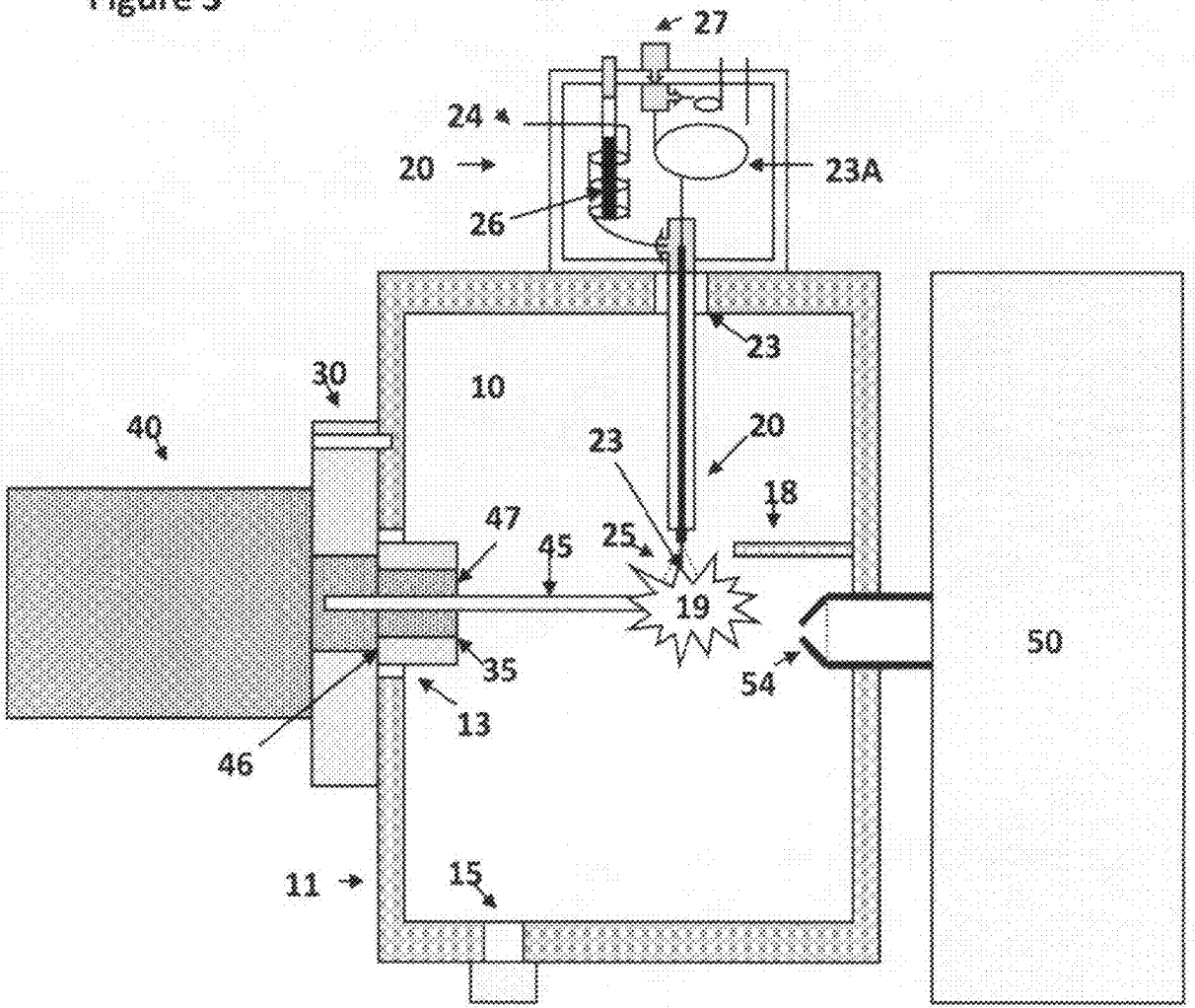
FIG. 3 is a sectional view of an embodiment of an API source showing a flange for the solids/liquid probe, the solids/liquid probe, the LC probe interfaced with the API source and a discharge device located where the electrospray capillary would normally be situated.
Figure 4:
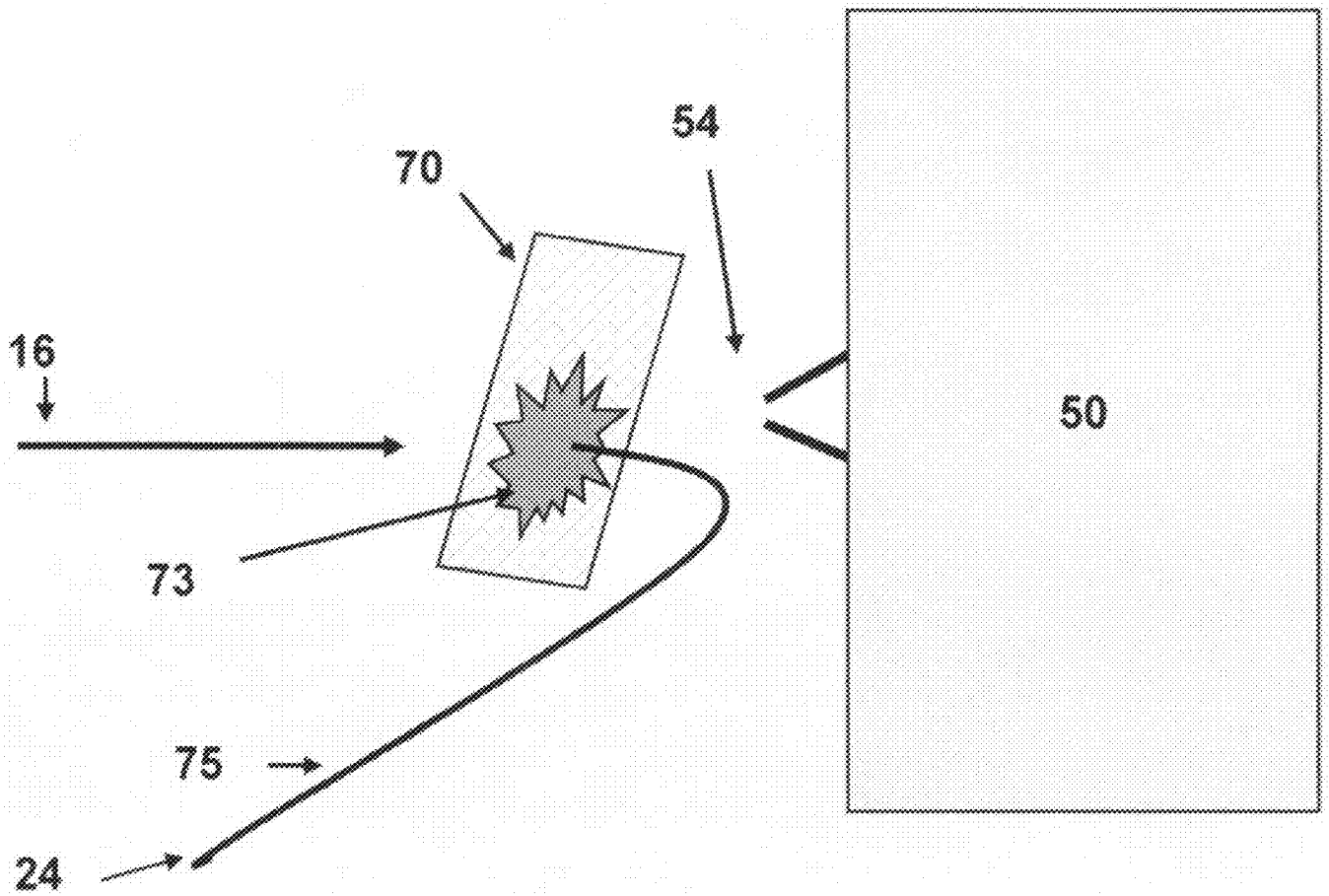
FIG. 4 shows a sectional view of an imaging configuration in which a capillary supplies a thin stream of hot gas to vaporize compounds from a limited area of the surface.
Figure 5:
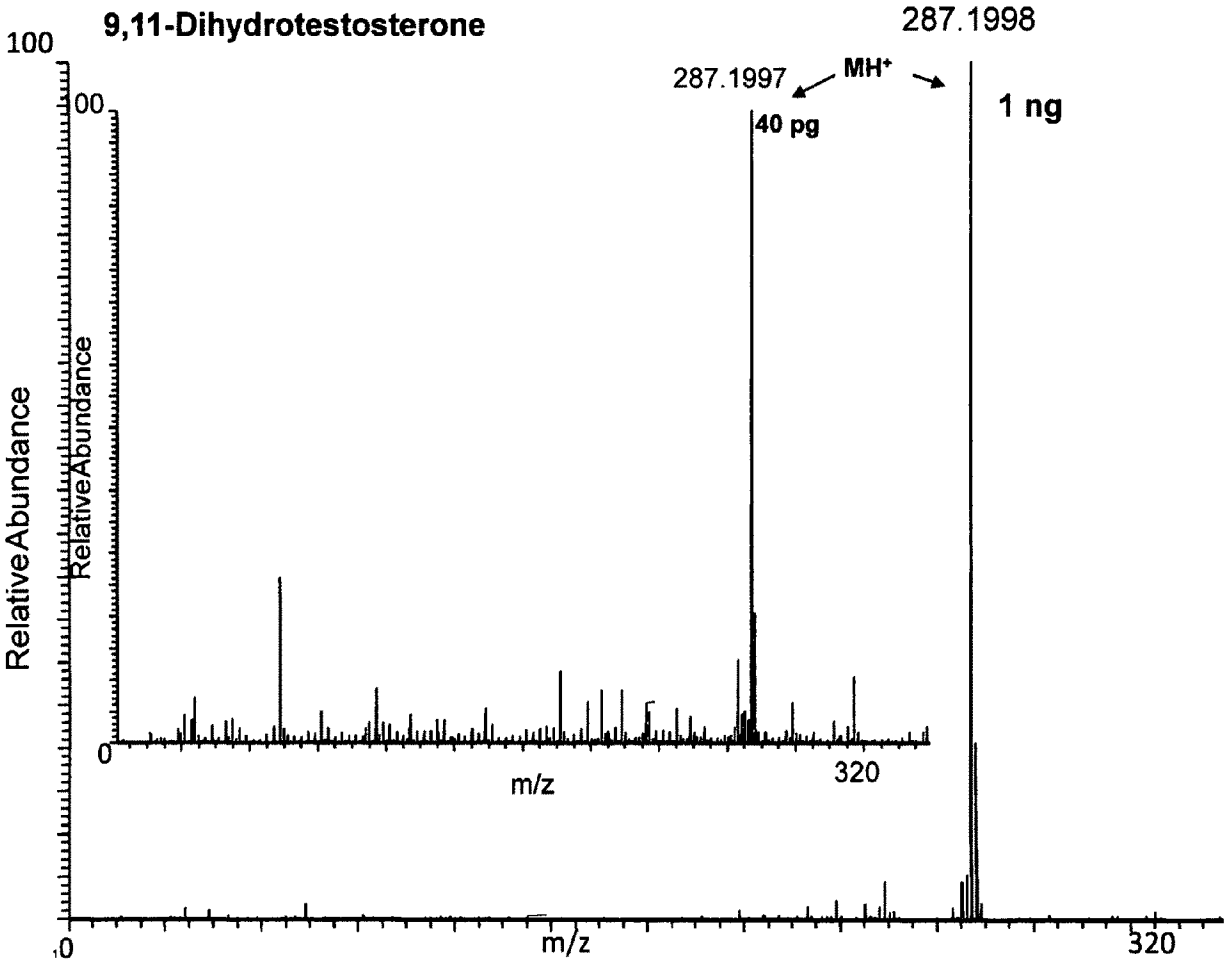
FIG. 5 is a mass spectrum of 9,11-dihydrotestosterone showing (a) 1 nanogram and (b) 40 picograms of compound added to the sample holder device.

An embodiment of the present invention of interfacing a direct introduction solids/liquid probe to an AP-LC/MS instrument is shown in FIG. 1. FIG. 2 shows a sectional view, in greater detail, of the solids/liquid probe and interface flange of the earlier figure. FIG. 3 shows an alternative embodiment of the ion source shown in FIG. 1 and FIG. 4 shows an imaging configuration. FIG. 5 shows an application of the solids/liquid API probe.

FIG. 1 shows an atmospheric pressure ionization source 10 comprising an enclosure or housing 11, and a flange 30 for interfacing and associated solids/liquid direct introduction probe 40 to an associated mass spectrometer 50. The mass spectrometer has an entrance aperture 54, also known as a skimmer aperture, which is surrounded by the housing 11. The ionization source 10 comprises at least one port 13 for receiving the flange 30. An electrode 16, supported by an electrically insulating sleeve 17, is mounted on the enclosure 11. The electrode 16 extends through the wall of the enclosure and is connected to a source of high voltage HV. A counter electrode 18, shown grounded to the enclosure 11, or the skimmer 54, is used in conjunction with the electrode 16. When the electrode 16 is energized by the high voltage source HV an electric discharge is generated between electrode 16 and the counter electrode. The volume within the enclosure 11 adjacent to the electrode 16 and the counter electrode 18 defines an ionization region 19.

In the device described herein, a probe 40 capable of holding a disposable or easily cleaned sample holding device 45 can be partially inserted into flange 30 (FIG. 1), thus allowing the sample on the holding device 45 to be inserted into the atmospheric pressure ionization region 19 of the mass spectrometer 50. The probe 40 can be inserted into flange 30 to the lip 46. The tubular region of the probe 47 must have an outer-diameter that is at least 0.0003 inch smaller than the diameter of the inner hole 35 in the flange 30 and not more than 0.1 inches smaller and preferably not more than 0.002 inches smaller. A hole drilled into the tubular end 47 of probe 40 has a diameter that is at least 0.0005 inches larger than the diameter of the end of the sample holding device 45 that is furthest from the sample end and no more than three times the diameter of the sample holding device 45. The depth of the hole depends on the length of the sample holding device 45 but is set so that when the lip 46 of the probe 40 is set against the flange, the sample tip of the sample holder 45 is inside the ionization region 19 and adjustable to be in the heated gas stream 25 supplied by the LC introduction probe 20 or at the furthest extension outside the heated gas region. The LC introduction probe 20 can be an interface probe between the LC and the API source for ESI or APCI, a combination ESI/APCI, a photoionization, or a specially built device to supply heated gas and fits onto port 23 of the ion source housing 11. The gas inlet 24 for the LC probe 20 is heated by a heating device 26 which is a resistive heater of kinds known to those practiced in the art.

FIG. 2 shows the direct introduction solids/liquid probe 40 and flange 30 in more detail. One method of adjusting the sample holding device is illustrated in which turning an outer thumb wheel 48 causes the probe shaft holder 43 for the high temperature tolerant material that acts as a sample holding device 45 to move in the X direction. The mechanism involves preventing the holder 43 from turning by use of a slot 41 and a set screw 49 while a threaded rod 42 with ends set in the thumb wheel 48 and the holder 43 turns with the thumb wheel 48. The thumb wheel 48 is held to prevent movement in the X direction by a set-screw 44 and an indention 48A in the thumb-wheel (48) shaft (48B). The allowed range of movement for the holder 43 and thus the sample holder 45 is from zero to 2 inches and preferably 1 inch. Other means of causing movement of the sample holder device familiar to those practiced in the art can be used to move the sample holding device 45. The tight fit of the probe tubular section 47 and the inner hole 35 in flange 30 as well as the fit of the sample holding device 45 in the sample holder 43 and the position of the inner flange hole 35 is sufficient to position the sample holding device 45 in the ionization region 19 and in the heated gas stream 25 from probe 20.

The sample end 45A of the sample holder 45, (FIG. 2), when in use is positioned near the entrance aperture 54 of the vacuum portion of the mass spectrometer 50 (FIG. 1) and in the heated gas flow 25 from the LC probe 20 as well as in the ionization region 19. Ionization is initiated using a Townsend or corona gaseous discharge (FIG. 1), or by photoionization. With photoionization, a photolamp capable of ionizing radiation is situated in a similar manner to the discharge needle 16. The vaporized analyte from the surface of the sample holding device 45 is swept out of the ionization region by the flow of a clean dry gas 25, such as nitrogen vapor typically from a liquid nitrogen supply that emanates from the gas introduction 24. This flow of gas, associated with the ionization region 19 having an outlet 15 open to the atmosphere, but usually vented to a hood, is necessary so that chemical components vaporized from the sample holder 45 are rapidly swept through the ionization region 19 through gas outlet 15 to prevent sample carryover observed in the mass spectrometer signal. Further, the ionization region 19 preferably is enclosed to such a degree that the dry and clean heated gas 25, preferably nitrogen, continuously added to the ionization region 19 through the LC probe 20 minimizes the presence of water vapor and contamination within the ionization region 19. Under these conditions, more chemically diverse compounds may be ionized relative to a so-called open APCI source, i.e. an ion source open to the atmosphere, or one that uses wet sources of nitrogen or other gases or in which gaseous contaminants have not been minimized. The enclosure 11 may have one or more vents 15 to allow the added heated gas 25 to flow out from the ionization region 19. When the sample holder device 45 is removed form the probe, the probe device can be inserted into flange 30 to seal the source from the laboratory air and the source is ready for ESI/APCI operation.

This invention provides a means for producing a more universal ion source than has previously been available to mass spectrometry. As shown in FIG. 1, a typical LC/MS ion source that has interchangeable ESI and APCI probes can be modified for API direct solids/liquid probe by adding a separate introduction flange 30 for the probe to mass spectrometry interface so that the probe 40 is always interfaced to the mass spectrometer 50 as shown in FIG. 1. The probe 40 inserted into flange 30 without the sample holder 45 acts to seal the ion source 10 when being used for ESI or APCI operation. The term 'probe' refers to a device for introducing compounds into a mass spectrometer ionization region and is well known to those experienced in the practice of mass spectrometry.

Typically, ionization is initiated by an electric discharge and can use the same high voltage electronics and discharge electrode 16, usually in the form of a metal needle that is available with commercial APCI ion sources designed for interface with a LC. Alternatively, if only an ESI source is available, an electric discharge can be initiated by placing an electrically conductive material such as a needle or a drawn metal-coated capillary in place of the electrospray capillary 23, (FIG. 3). With a sharp tip, discharges are generated in the voltage range used by the ESI source. In a typical discharge ionization source, the primary ionization processes involves stripping of electrons from abundant gaseous species for positive ionization, or for negative ionization electron resonant or dissociative electron attachment to the most electronegative gaseous components. The electron stripping process produces positive ions that undergo further reactions during collisions and result in charge transfer where thermodynamically favored. For water vapor, hydronium ions are produced which undergo further collisions resulting in production of protonated water clusters, (i.e. $[(H_2O)_x]H^+$). Because these gas phase reactions are diffusion controlled and at atmospheric pressure collisions occur on a very short time scale, the ionization cascade causes most of the available charge to reside on the more basic molecules. Because of the abundance of water vapor or even more basic substances such as solvent and contaminants, in APCI, only compounds more basic than, for example, the protonated water clusters become ionized.

This cascading effect can be used to advantage by for example adding a reactive gas 66 or liquid 67 through the liquid inlet 27 (FIGS. 1 & 3) of the LC ESI or APCI probe 20, such as ammonia gas or ammonium hydroxide solution, so that only compounds that can either attach $NH_4^+$ ions or are more basic than $[(NH_3)_m)]H^+$ will be ionized. Alternatively, adding no gas or liquid through the inlet 27 reduces the amount of vapor in the ionization region 19 so that higher energy species are available for ionization. Under these conditions compounds such as methylcyclohexanone, naphthalene, dimethylphenol, dinitrobenzene, chloromethylphenol, and even hydrocarbons, which do not ionize or ionize poorly under positive ion LC/API conditions, ionize readily.

Ionization may also be generated using a UV lamp with photo-energy output between about 8 and 12 electron volts (eV). In photoionization, ionization occurs by stripping an electron from those molecules in which the ionization potential is below the eV output of the UV lamp source. Photoionization light sources are covered by a number of patents, for example U.S. Pat. Nos. 5,338,931, 5,808,299, 5,393,979, 5,338,931, 5,206,594. Even though the molecules of interest are ionized directly, they can lose charge by ion-molecule reactions, as described above, to water and other contaminants in the ionization region.

Alternatively, ionization can be produced from an ESI capillary as described in U.S. Pat. No. 6,297,499. Sensitivity may be enhanced by use of lower flow rates of liquid through the capillary. Therefore, nanospray as described in U.S. Pat. No. 5,788,166 by Valaskovic, et al. appears to produce the most sensitive results using this method of ionization. Commercially available nanospray needles can operate for many hours with just a few microliters of solvent and is a simple solution for production of primary ions. By using the nanospray needle in the typical manner used for nano-electrospray, but using a pure solvent such as methanol, water, acetonitrile or mixtures thereof, the gas phase analyte molecules vaporized from the probe described herein become entrained in the liquid droplets and are ionized by the electrospray process described above. This ionization mode is more selective as to the types of compounds that can be ionized and generally produces only quasi-molecular ions with little or no fragmentation. The advantage of this ionization process is that typically only $[M+H]^+$ ions are produced in the positive ion mode from polar compounds that are sufficiently basic to accept a proton from the liquid media used to produce the primary ionization, assuming no thermal fragmentation. The ionization can be influenced by addition of an additive to either the solvent being used in the nanospray process or into the gas phase. For example, addition of $NH_3$ gas into the ionization region will cause only molecules more basic than ammonia gas to be ionized by protonation, but cationization by $NH_4^+$ addition will occur with a wider variety of compounds. This allows the ionization process to be tailored to the analytical problem.

With some of these ionization methods, little fragmentation is obtained. However, when fragmentation is needed for structural elucidation it can be generated in the skimmer-cone region on the low pressure side 53 of the entrance aperture 54, (FIGS. 1 & 3) of atmospheric pressure ion sources by application of a voltage that increases the collision energy of ions in this intermediate pressure region. Alternatively, so called MS/MS or MS″ mass spectrometers can be used to select an ion of a specific mass using one mass analyzer followed by fragmentation of the selected ions by gas or surface collisions and then using a second mass analyzer to obtain a mass spectrum of the fragment ions. Combining MS/MS and selected ion, or multiple ion, monitoring with the solids/liquid introduction probe described here is a powerful and highly selective tool for the analysis of trace volatile components in complex mixtures. Because a large number of mass spectrometers that are designed for LC/MS operation are capable of high accuracy mass measurement of ions, using the arrangement of the present invention these instruments can now be used to accurately measure the mass of ions produced in the gas phase by vaporization from the atmospheric pressure solids/liquid API probe described herein.

Thus, the method described to produce ions, either positive or negative, from gaseous compounds at atmospheric pressure with analysis by mass spectrometry has a number of advantages over current instrumentation. For example, a solids/liquid introduction probe can be interfaced to a commercially available LC/MS instrument. Compounds can be selectively vaporized from the probe sample introduction device by increasing the temperature of the heated gas that strikes the sample area of the probe. Thus, a separation of compounds is achieved that is based on the volatility of components present in a mixture. Alternatively, a material such as those used for molecular adsorption with liquid or gas chromatography can be use to adsorb compounds with selective release based of adsorption and volatility. The use of a hot gas stream to vaporize compounds has the advantage that compounds are heated at the surface rather than beneath the surface as in resistive heating. The heated gas sweeps molecules from the surface as they attain sufficient energy to escape the forces that bind them to the surface. This is a more gentle method for releasing compounds from a surface and occurs at a lower temperature than required to vaporize the molecules using resistive heating. Therefore, thermal fragmentation is reduced. Compounds ionized with these methods will have all of the analytical benefits of the mass spectrometer being employed as to generation of fragmentation and making accurate mass measurements.

FIG. 1 shows an embodiment of the invention in which an enclosure 11 is attached to a mass spectrometer 50 with an entrance aperture, or nozzle, 54 for introducing gas into the vacuum region of the mass spectrometer 50. The enclosure 11 has a arrangement for generating a gaseous discharge by applying a high voltage (typically from 1000 to 10,000 volts, preferably from 2000 to 6000 volts) to a metal needle electrode 16. A counter electrode 18 may also be present and is typically at ground potential. The ionization region of enclosure 11 has an inlet for optional introduction of gases 66 or liquids 67 through 27 of probe 20. The enclosure 11 also has a gas outlet 15 through which allows the gases to quickly exit the enclosed region. FIG. 1 shows a LC probe 20 with a connection 27 for an LC column or liquid/gas infusion so that a liquid or gas can enter the ionization region 19. The heated gas entrance 24 allows the gas to flow through metal or fused silica tubing to be heated by heat source 26 before passing through the sheath tube 26A and over the capillary tubing 22A. The discharge needle electrode 16 is typically located within 5 centimeters of aperture 54.

FIG. 3 shows an embodiment of the invention in which the ionization region enclosure 11 contains an entrance aperture, or nozzle, 54 for introduction of ions into the mass spectrometer vacuum region 53, a metal or metal coated needle-shaped electrode 23A for application of a high voltage to generate a gaseous discharge, or alternatively, 23A can be a nanospray capillary containing a solvent for ESI, a counter electrode 18 for use with electrospray or discharge ionization, a gas outlet, or vent, 15, and a gas inlet 24 for introducing a heated gas. The source enclosure 11 also has a port, or opening, 23 for an LC interface probe 20 and a port 13 for receiving the solids/liquid introduction probe 40.

FIG. 4 shows the basic elements of an imaging method in which the mass spectrometer 50 and associated entrance aperture 54 are shown along with a plate 70 for mounting a thin sample for imaging, a heated capillary for supplying a narrow section of heated gas to sample 73 are shown. The heated gas 25 emanating from capillary 75 vaporizes compounds from sample 75 which are ionized by the discharge generated from a voltage placed on needle 16. The ions produced from vaporizable compounds in sample 75 are swept through the mass spectrometer entrance aperture for mass to charge separation. By moving plate 75 in a controlled manner, mass spectra are obtained from small heated areas that can be used to form an image of selected ions. Other embodiments using these basic components can be envisioned.

It has been discovered that ionization can be altered by the addition of gases to the ionization region. In particular, bathing the ionization region with dry clean inert gas such as nitrogen increases the types of compounds amenable to this method. FIG. 5*a* shows an example of results obtained by vaporizing 1 microliter of a 1 part per million solution (1 nanogram) of the steroid 9,11-dihydrotestosterone using the solid/liquid introduction probe with only heated nitrogen gas entering the closed API source region. FIG. 5*b* is the same compound but with only 1 microliter of a 40 parts per billion solution ($40\times10^{-12}$ grams) applied to the sample holding device of the solids/liquid introduction probe. The ion observed at m/z 287 is the protonated molecular ion of dihydrotesterone, a compound that is poorly ionized by either ESI or APCI requiring several hundred times more sample to achieve comparable results.

It is also known that additive gases, such as ammonia in the positive ion mode or methylene chloride in the negative ion mode, can be used to alter the ionization process. The addition of ammonia gas increases the specificity of the ionization. Either positive or negative ions can be used for the analysis of compounds vaporized from the sample holder of the solids/liquid API probe. In the case of negative ionization, methylene chloride is an additive gas that can be used to enhance the ionization process for certain compound types. The sensitivity of this method is superior to that of currently available ionization methods used with vacuum solid probe analyses.

Those skilled in the art, having the benefit of the teachings of the present invention as hereinabove set forth may effect modifications thereto. Such modifications are to be construed as lying within the contemplation of the present invention, as defined by the appended claims.

FIGURES

FIG. 1: Atmospheric pressure ion (API) source showing LC interface probe (ESI or APCI) and solids/liquid introduction probe.

FIG. 2: Solids/liquid introduction probe and associated flange.

FIG. 3: API source with discharge voltage supplied from electrospray capillary.

FIG. 4: Imaging ion source using discharge and heated gas from a capillary.

FIG. 5: Mass spectra of 1 nanogram and 40 picograms of a steroid using the solid/liquid introduction probe.

What is claimed is:

1. An Apparatus for producing ions for analysis by a mass spectrometer, comprising:

an enclosure having at least one wall and interior at substantially atmospheric pressure;

solid or neat liquid probe means for individually and directly inserting a solid or neat liquid sample into said enclosure and removing any remaining solid or neat liquid sample out of said enclosure;

flange means for mounting and aligning said probe means through a port in said at least one wall of said enclosure;

sample holding means on said solid or neat liquid probe means for receiving said solid or neat liquid sample, said sample holding means being comprised of a heat tolerant material;

adjusting means on said solid or neat liquid probe means for positioning said sample holding means with said sample in an ionization region in said atmospheric pressure enclosure;

means for ionizing said sample by forming a vaporized analyte in said ionization region; and a port in said enclosure for transferring ions in the form of said vaporized analyte into a mass spectrometer.

2. Apparatus in accordance with claim 1 wherein said means for ionizing said solid or neat liquid sample comprises means for generating a corona discharge in said ionization region.

3. Apparatus in accordance with claim 1 wherein said means for ionizing said solid or neat liquid sample comprises means for supplying a heated gas in said ionization region.

4. Apparatus source of claim 3, wherein said means for introducing the heated gas comprises a port for introducing the heated gas also comprises a heater for heating the gas.

5. Apparatus in accordance with claim 1 wherein said means for ionizing said solid or neat liquid sample comprises a photolamp for photo ionization of said sample in said ionization region.

6. Apparatus in accordance with claim 1 wherein said adjusting means adjust said sample holding means longitudinally along an axis line of said solid or neat liquid probe means.

7. Apparatus in accordance with claim 1 wherein said adjusting means adjusts the position of said sample holder to within 5 centimeters of said port for transferring ions to said mass spectrometer.

8. Apparatus of claim 1, wherein the apparatus further comprises a port for introducing a reactive gas and a vent for venting excess reactive gas from the enclosure.

9. Apparatus source of claim 1 wherein said sample holding means comprises a resistive heater for vaporizing the solid or neat liquid sample.

10. Apparatus source of claim 1 wherein the ionization region includes a sharp-edged or pointed electrode onto which a high voltage is applied to generate a Townsend or corona discharge.

11. Apparatus source of claim 1 wherein the sample holding device is comprised of a high temperature tolerant material and aligned so that a heated gas strikes the sample holding means at a position such that analyte to be analyzed is heated, thus assisting in vaporizing compounds that comprise the sample.

12. Apparatus source of claim 11 wherein the sample holding means is adjustable to allow the sample to be moved into and out of the heated gas stream to assist or prevent vaporization of analyte.

13. Apparatus of claim 11 wherein said heat tolerant material of the sample holding means is selected from the group consisting of metal, glass, ceramic, materials containing silica and other materials suitable for concentrating volatile compounds from gases or liquids.

14. Apparatus of claim 11 wherein the sample holding means containing the sample is within 3 cm of said port of the mass spectrometer.

15. Apparatus of claim 14 wherein the sample holding means containing the sample is within 1 cm of said port of the mass spectrometer.

16. Apparatus of claim 11 including an exit for the heated gas which is within 5 cm of the sample being vaporized.

17. Apparatus of claim 11 including an exit for the heated gas which is within 1 cm of the sample being vaporized.

18. Apparatus of claim 1 wherein said sample holding means is a flat plate adapted to hold a thin slice of tissue or material and includes a capillary column for providing a heated gas stream directed at said sample holding means.

19. Apparatus of claim 18 wherein the capillary column has an inner diameter of less than 1 mm, and an exit tip which is within 2 mm of the sample holding means.

20. Apparatus of claim 18 wherein the capillary column has an inner diameter of less than 0.05 mm, and an exit tip is within 1 mm of the sample holding means.

21. Apparatus of claim 18 wherein a surface of the flat plate of the sample holding means is within 2 cm of the ion entrance port to the mass spectrometer.

22. Apparatus of claim 18 wherein a surface of the flat plate of the sample holding means is within 2 mm of the ion entrance port to the mass spectrometer.

23. Apparatus of claim 21 wherein the sample holding means is moveable in a controlled fashion relative to said heated gas flow from the capillary column so as to produce vapors and subsequently ions from selected areas of the sample surface and produce an image of the materials vaporized from the surface through relating the mass spectra of the ions to the position of the analyte on the plate of the sample holding means.

24. Apparatus of claim 1 including means for mounting said solid or neat liquid probe means in said flange means to provide substantially the exclusion of atmospheric gas from said enclosure.

25. A method for producing ions for analysis by a mass spectrometer, comprising the steps of:

providing an enclosure having at least one wall and having an interior at substantially atmospheric pressure;

introducing directly into said enclosure an individual solid or a neat liquid sample and removing any remaining sample out of said enclosure using a solid or neat liquid probe means;

utilizing a flange means for mounting and aligning said solid or neat liquid probe means through said at least one of wall of said enclosure;

mounting said solid or neat liquid probe means in said flange means to provide substantial exclusion of atmospheric gas from said enclosure;

providing sample holding means on said solid or neat liquid probe means for receiving said solid or neat liquid sample, said sample holding means being comprised of a heat tolerant material;

adjusting said solid or neat liquid probe means for positioning said sample holding means with said sample in an ionization region in said atmospheric pressure enclosure;

ionizing said sample by forming a vaporized analyte in said ionization region; and transferring ions through a port in the form of said vaporized analyte into a mass spectrometer.

26. A method in accordance with claim 25 wherein said step of directly introducing into said enclosure includes the steps of placing a solid or neat liquid sample onto said sample holding means of said solid or neat liquid probe means, inserting said solid or neat liquid probe means into said flange means and adjusting said sample holder on said probe means to place said sample holder in the ionization region.

* * * * *